US010406417B1

(12) United States Patent
Le Tourneau et al.

(10) Patent No.: US 10,406,417 B1
(45) Date of Patent: Sep. 10, 2019

(54) HOCKEY PUCK PASSING MACHINE AND SHOOTING TRAINER

(71) Applicant: Government of the United States as represented by the Secretary of the Air Force, Wright-Patterson AFB, OH (US)

(72) Inventors: Nicholas Le Tourneau, Perham, MN (US); Ricardo Arocho, Camuy, PR (US)

( * ) Notice: Subject to any disclaimer, the term of this patent is extended or adjusted under 35 U.S.C. 154(b) by 0 days.

(21) Appl. No.: 16/249,043

(22) Filed: Jan. 16, 2019

(51) Int. Cl.

| | |
|---|---|
| ***A63B 69/00*** | (2006.01) |
| ***A63B 69/40*** | (2006.01) |
| ***A63B 71/06*** | (2006.01) |
| *A63B 102/24* | (2015.01) |

(52) U.S. Cl.
CPC ..... *A63B 69/0026* (2013.01); *A63B 69/406* (2013.01); *A63B 71/0622* (2013.01); *A63B 2069/402* (2013.01); *A63B 2071/0694* (2013.01); *A63B 2102/24* (2015.10)

(58) Field of Classification Search
CPC .. A63B 69/00; A63B 69/0024; A63B 69/0026
USPC ..... 473/446; 124/6, 8
See application file for complete search history.

(56) References Cited

U.S. PATENT DOCUMENTS

| | | | | |
|---|---|---|---|---|
| 3,665,910 A | | 5/1972 | Boni | |
| 3,794,318 A | * | 2/1974 | Holmes | A63B 63/06 473/446 |
| 3,838,677 A | | 10/1974 | Alvares | |
| 3,876,201 A | | 4/1975 | King | |
| 4,607,842 A | * | 8/1986 | Daoust | A63B 24/0021 124/51.1 |
| 4,774,928 A | | 10/1988 | Kholin | |
| 5,069,451 A | | 12/1991 | Martens et al. | |
| 5,255,917 A | * | 10/1993 | Morrow | A63B 69/406 124/42 |
| 5,396,876 A | * | 3/1995 | Liscio | A63B 69/0024 124/34 |
| 5,407,198 A | | 4/1995 | Morrow | |
| 5,647,338 A | | 7/1997 | Martin | |
| 5,846,144 A | | 12/1998 | Bothers | |
| 5,857,451 A | | 1/1999 | Ciluffo et al. | |
| 6,024,078 A | | 2/2000 | Hollis et al. | |
| 6,514,162 B1 | * | 2/2003 | Karellas | A63B 47/002 124/16 |
| 6,605,010 B1 | | 8/2003 | Rydza | |

(Continued)

*Primary Examiner* — Mark S Graham
(74) *Attorney, Agent, or Firm* — AFMCLO/JAZ; Jeffrey R. Moore

(57) ABSTRACT

According to various embodiments, a training device for hockey players is disclosed herein. The training device includes a puck sorting system for holding and orienting hockey pucks. The puck sorting system includes a puck drum having bottom and side portions and configured to hold therein a plurality of hockey pucks. The bottom portion of the puck drum has rotatably mounted thereon a conical puck agitation device configured to orient the plurality of hockey pucks into a predefined position. The training device further includes a puck launching system attached to the puck sorting system. The puck launching system includes a sloped tube operable to receive oriented hockey pucks and convey hockey pucks to a puck launcher. The puck launcher is configured to shoot hockey pucks via a spinning launching wheel driven by a launching motor.

20 Claims, 9 Drawing Sheets

(56) References Cited

U.S. PATENT DOCUMENTS

| | | | | |
|---|---|---|---|---|
| 7,121,964 | B1 * | 10/2006 | Dahm | A63B 69/0026 473/446 |
| 7,166,045 | B1 | 1/2007 | Linner et al. | |
| 7,662,054 | B2 * | 2/2010 | Erickson | A63B 63/004 473/422 |
| 9,199,148 | B2 | 12/2015 | Krohl et al. | |
| 9,452,339 | B1 | 9/2016 | Shah et al. | |
| 9,914,041 | B2 | 3/2018 | Vorozilchak | |
| 2004/0082411 | A1 * | 4/2004 | Fluckiger | A63B 69/0026 473/446 |
| 2011/0077108 | A1 * | 3/2011 | Gulka | A63B 47/002 473/446 |
| 2016/0082338 | A1 | 3/2016 | Klett | |
| 2018/0001173 | A1 | 1/2018 | Cupa | |

* cited by examiner

HOCKEY PUCK PASSING MACHINE AND SHOOTING TRAINER

GOVERNMENT INTEREST

The embodiments described herein may be manufactured, used and/or licensed by or for the United States Government without the payment of royalties thereon.

FIELD OF THE DISCLOSURE

The embodiments herein generally relate to hockey training devices, and more particularly, to an automated, portable hockey puck passing machine to improve shooting accuracy and reaction time of hockey players training therewith.

BACKGROUND

There is currently a market gap in the hockey industry for a portable, relatively low-cost, accuracy training device that can be attached to any hockey net and is capable of automatically shooting pucks at different angles, speeds, and intervals. Conventional training devices include a simple training board with shooting pockets, an expensive training room that is not portable, and a programmable box that can shoot pucks. However, these devices are limited in the number of pucks they can hold, their ability to sort and orient pucks prior to launch, and their ability to shoot at different angles, speeds, and intervals.

SUMMARY OF THE INVENTION

Various deficiencies in the prior art are addressed by systems, methods, architectures, mechanisms and/or apparatus configured to provide a training device for hockey players.

The training device includes a puck sorting system for holding and orienting hockey pucks. The puck sorting system includes a puck drum having bottom and side portions and configured to hold therein a plurality of hockey pucks. The bottom portion of the puck drum has rotatably mounted thereon a conical puck agitation device configured to orient the plurality of hockey pucks into a predefined position. The training device further includes a puck launching system attached to the puck sorting system. The puck launching system includes a sloped tube operable to receive oriented hockey pucks and convey hockey pucks to a puck launcher. The puck launcher is configured to shoot hockey pucks via a spinning launching wheel driven by a launching motor.

In an alternative embodiment, the training device includes a puck sorting system for holding and orienting hockey pucks. The puck sorting system includes a puck drum having bottom and side portions and configured to hold therein a plurality of hockey pucks. The bottom portion of the puck drum has mounted thereon a conical puck agitation device including a stirring mechanism to orient the plurality of hockey pucks into a predefined position. The training device further includes a puck launching system attached to the puck sorting system. The puck launching system includes a sloped tube operable to receive oriented hockey pucks and convey hockey pucks to a puck launcher. The puck launcher is configured to shoot hockey pucks via a spinning launching wheel driven by a launching motor.

In another alternative embodiment, the training device includes a puck sorting system for holding and orienting hockey pucks. The puck sorting system includes a puck drum having bottom and side portions and configured to hold therein a plurality of hockey pucks. The bottom portion of the puck drum has rotatably mounted thereon a conical puck agitation device configured to automatically orient the plurality of hockey pucks into a predefined position. The training device further includes a puck launching system attached to the puck sorting system. The puck launching system includes a sloped tube operable to receive oriented hockey pucks and convey hockey pucks to a puck launcher. The puck launcher is configured to shoot hockey pucks via a spinning launching wheel driven by a launching motor.

Various other features and advantages will be made apparent from the following detailed description and the drawings.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only exemplary embodiments of the invention and are not, therefore, to be considered to be limiting its scope, the invention will be described and explained with additional specificity and detail through the use of the accompanying drawings, in which:

FIG. 1(*b*) depicts a side view of the portable hockey training device according to an embodiment of the present invention;

FIG. 1(*c*) depicts a top view of the portable hockey training device according to an embodiment of the present invention;

FIG. 1(*d*) depicts a perspective view of the portable hockey training device according to an embodiment of the present invention;

FIG. 2(*b*) depicts a side view of the puck sorting system according to an embodiment of the present invention;

FIG. 2(*c*) depicts a top view of the puck sorting system according to an embodiment of the present invention; and FIG. 2(*d*) depicts a perspective view of the puck sorting system according to an embodiment of the present invention.

FIG. 3(*b*) depicts a side view of the puck launching system and puck sorting system according to an embodiment of the present invention;

FIG. 3(*c*) depicts a top view of the puck launching system and puck sorting system according to an embodiment of the present invention; and FIG. 3(*d*) depicts a perspective view of the puck launching system and puck sorting system according to an embodiment of the present invention.

DETAILED DESCRIPTION OF THE INVENTION

The following description and drawings merely illustrate the principles of the invention. It will thus be appreciated that those skilled in the art will be able to devise various arrangements that, although not explicitly described or shown herein, embody the principles of the invention and are included within its scope. Furthermore, all examples recited herein are principally intended expressly to be only for illustrative purposes to aid the reader in understanding the principles of the invention and the concepts contributed by the inventor(s) to furthering the art, and are to be construed as being without limitation to such specifically recited examples and conditions. Additionally, the term, "or," as used herein, refers to a non-exclusive or, unless otherwise indicated (e.g., "or else" or "or in the alternative"). Also, the various embodiments described herein are not necessarily mutually exclusive, as some embodiments can be combined with one or more other embodiments to form new embodiments.

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily limit any of the various claimed inventions. Moreover, some statements may apply to some inventive features but not to others. Those skilled in the art and informed by the teachings herein will realize that the invention is also applicable to various other technical areas or embodiments.

Generally speaking, the various embodiments disclosed herein provide a portable training device for hockey athletes to improve their shooting accuracy and reaction time. The training device may include an automated hockey puck passing machine coupled with detachable "shooter tutor" board, accuracy data collection system, and a funnel capable of holding over 50 pucks. Off-ice training feature may include a netted collection system. Major improvements to several aspects of hockey training including portability, accuracy data collection, and puck distribution/collection systems. In addition, the machine can be capable of closing/opening shooting pockets at random, lighting up specific pockets to target as a puck is shot to train reaction time, and a visible shot data board display. The size and portability also allow for lower cost manufacturing and simpler assembly, leading to a significantly cheaper product than conventional training devices.

Figure 1A:
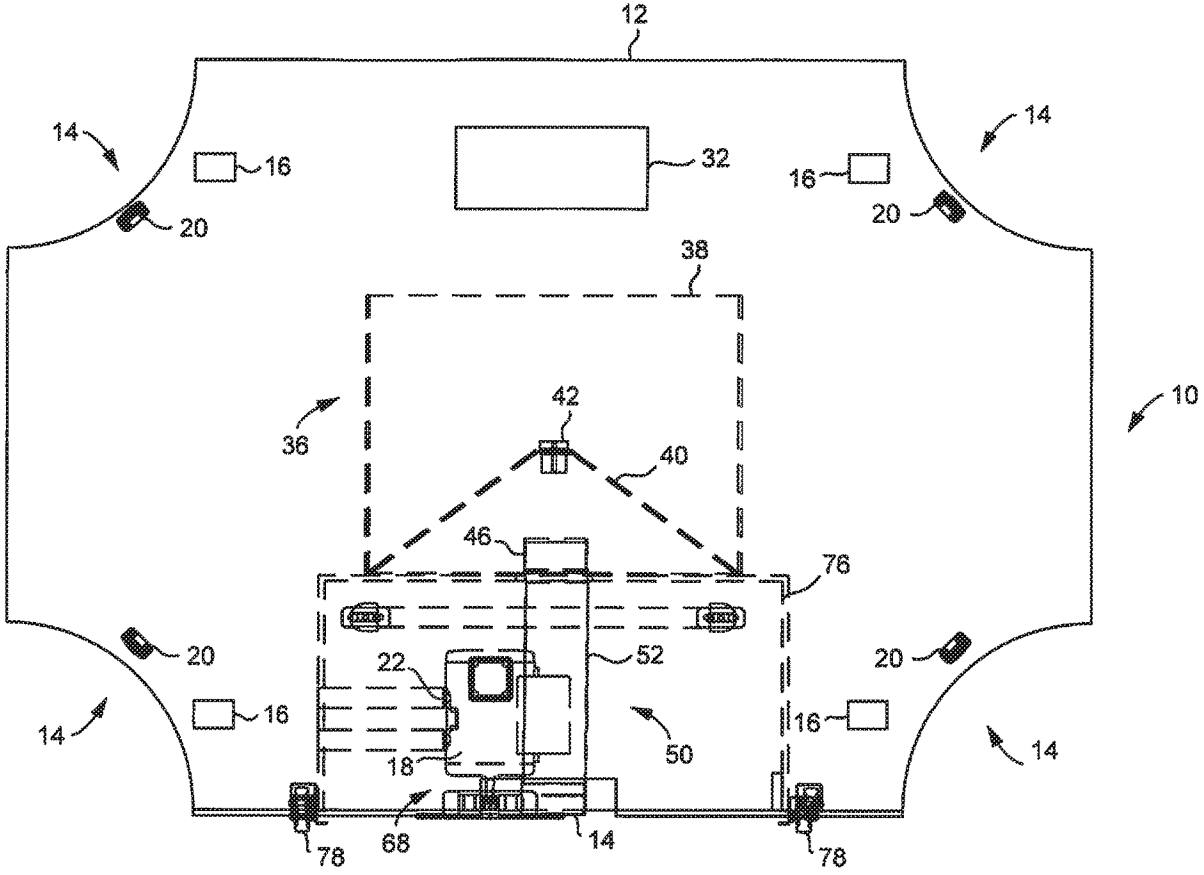
FIG. 1(*a*) depicts a front view of a portable hockey training device according to an embodiment of the present invention.
Figure 1C:
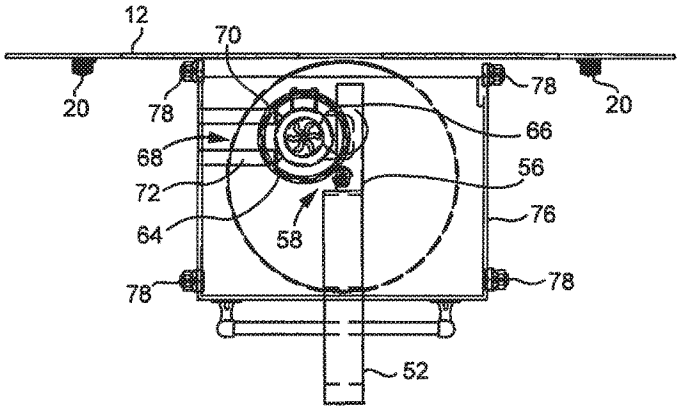
Figure 1B:
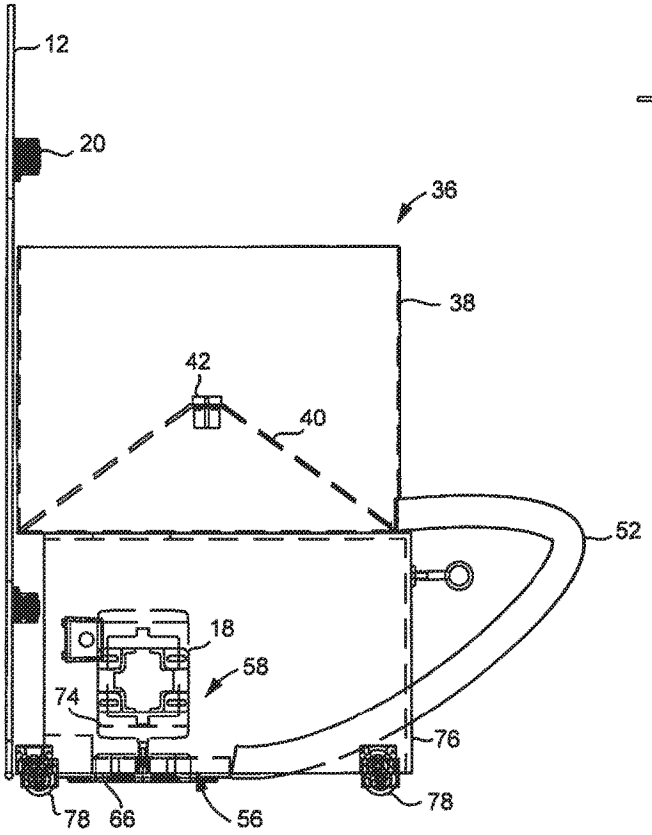
Figure 1D:
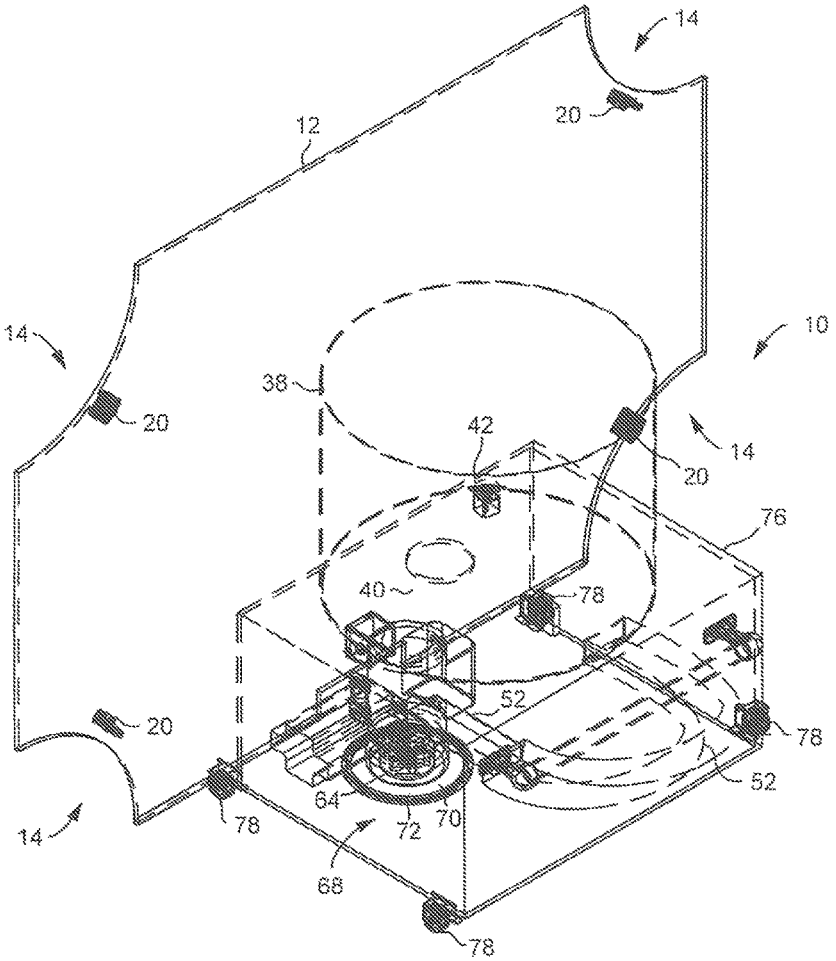

FIGS. 1(*a*)-1(*d*) depict different views of a portable training device 10 according to an embodiment, which device will now be described with reference to the various figures.

The portable training device 10 may include a training board 12. In a preferred embodiment, the training board 12 is a 0.220"×48"×96" piece of polycarbonate or polyethylene plastic. The dimensions of 48"×96" is the standard ice hockey goal size. The training board 12 can be a high-impact piece of plastic with cold forming less than 100× the thickness and with a temperature range of 40° F. to 180° F., allowing it to be used for on- or off-ice premises. The training board 12 can be oriented to stop hockey pucks being shot at the training device 10. The training board 12 may be fitted with four cut-out corner pockets 14 and an additional cut-out bottom-center pocket 14. In a preferred embodiment, the cut-out corner pockets 14 are quarter circles measuring approximately 12" in diameter, but other shapes may be used in alternative embodiments. The cuts may be performed using a high-speed water-jet cutter to ensure accuracy and conformity to design. The training board 12 also includes one or more lights 16, such as light emitting diode (LED) lights, that can run along the edge of each cut-out pocket 14. These lights 16 can be connected to a control system 18, which may include or comprise a central processing unit. Lights 16 can be programmed to illuminate randomly or in a particular order to assist a player in shot selection. The training board 12 also includes a number of attachment holes 20 cut into the edges of the training board 12 in order to attach the training board 12 to the pipes of a standard hockey net (not shown) using detachable nylon straps. The training board 12 may be removable if desired.

The portable training device 10 may further include a shot analytics system 22. The shot analytics system 22 is augmented through the use of the control system 18. The shot analytics system includes vibration plates attached to swing-away shields in front of each of the cut-out pockets 14 in the training board 12. The vibration plates 24 are connected to the control system 18 and configured to sense any impact to the swing-away shield 26 to which it is attached in order to register as a shot on target to the control system 18.

Alternatively, the shot analytics system may include photovoltaic light sensors on the inside of each pocket 14 in order to track when pucks enter past the threshold of the pocket 14 to register a shot on target. The light sensors are housed in a steel or aluminum housing.

The control system 18 may track each puck passed out through the training board 12, as well as shots on target, in order to formulate a shot percentage shown via a display 32 (such as an electronic shot board) on the front of the training board 12 or elsewhere on the training device 10. The shot analytics system 22 may be reset using a reset button located on the training device 10, or may automatically reset during a power cycle. The shot analytics system 22 is programmable through a radio frequency (RF) remote transmitter, an application on a mobile device, or other buttons included on the training device 10.

Figure 2A:
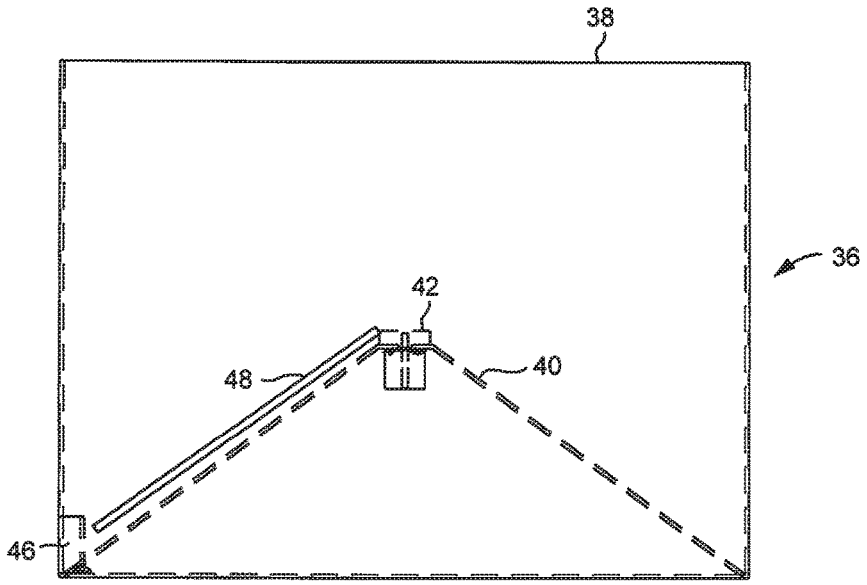
FIG. 2(*a*) depicts a front view of a puck sorting system according to an embodiment of the present invention.
Figure 2B:
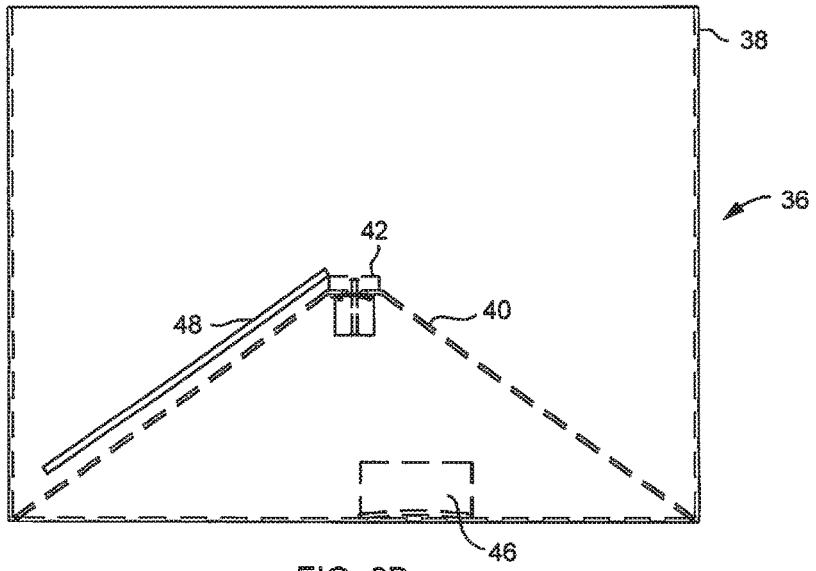
Figure 2D:
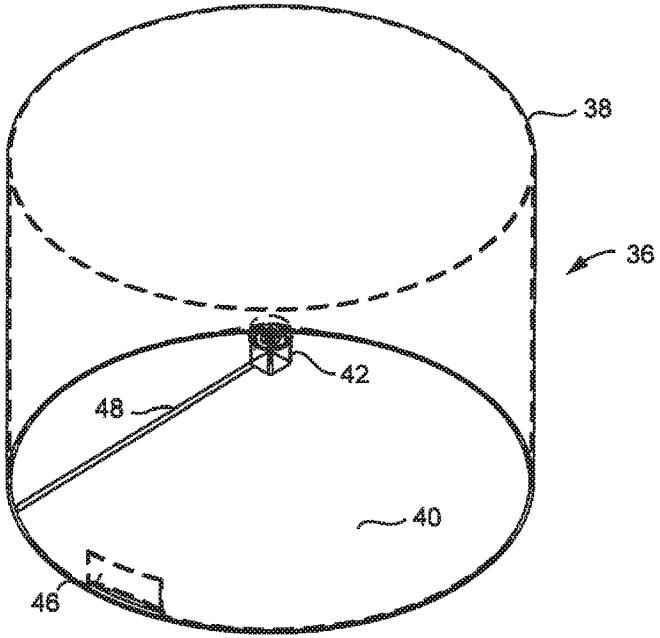
Figure 2C:
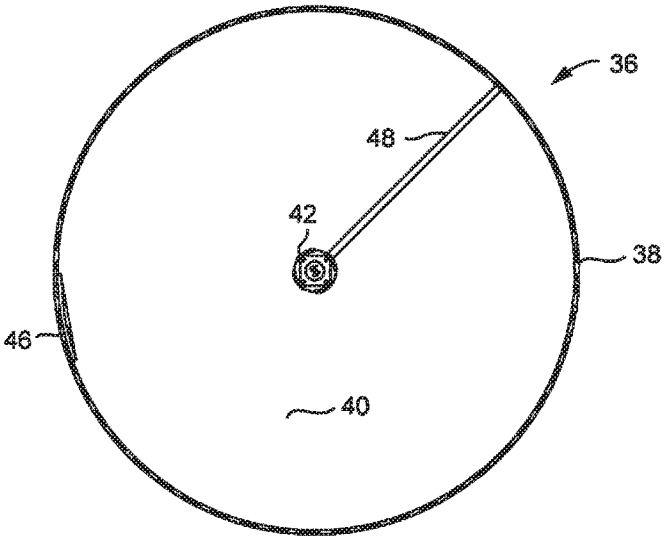

The portable training device 10 further includes a puck sorting system 36. Specifically, FIGS. 2(*a*)-2(*d*) depict different views of a puck sorting system 36 according to an embodiment and suitable for use in the portable training device 10 discussed above with respect to FIGS. 1(*a*)-1(*d*).

The puck sorting system 36 includes a puck drum 38 having bottom and side portions, which may be a thin, high molecular weight plastic cylinder in a preferred embodiment. In the preferred embodiment, the dimensions are 12 in. diameter and 18 in. height for the cylinder. The puck sorting system 36 further includes a puck agitation device (preferably and referred to herein as a cone) 40 mounted on the bottom portion of the puck drum 38. In a preferred embodiment, the dimensions are 11 in. diameter and 8 in. height. While plastic may be used in a preferred embodiment for the cone 40, other materials may be used as well. Based on the dimensions of the puck drum 38 and cone 40 in the preferred embodiment, the puck sorting system 36 may hold at least 100-150 standard size hockey pucks, considering possible asymmetrical stacking of pucks, and in some embodiments more than 50.

The puck drum 38 allows pucks to be dumped or placed inside without stacking or arranging of any sort. Once placed in the puck drum 38 and powered on, the cone 40 is operable to slowly rotate in a stirring action, which will aggravate the initial orientation of the pucks placed in the puck drum 38. The sloped surface of the cone 40 will allow pucks to be forced toward the bottom of the puck drum 38, and the stirring forces them around the puck drum 38 in a clockwise motion. This allows for orienting the hockey pucks into a predefined position, which in some embodiments, may be automatic. The cone 40 inside the drum 38 is actuated by a shaft 42 (½" in a preferred embodiment) through the bottom of the drum 38, attached to a high-torque motor (not pictured) used to rotate the cone 40. A rectangular outlet 46 on the bottom edge of a side of the puck drum 38 facilitates single entry of a hockey puck through the outlet 46 for passage to a puck launching system 50, explained in further detail below.

In an alternative embodiment, the cone 40 may remain stationary and the pucks can be sorted and oriented by a stirring mechanism 48 that spins around the cone 36. The stirring mechanism 48 is actuated by the shaft 42 through the bottom of the drum and attached to a high-torque motor (not pictured) used to rotate the stirring mechanism 48.

Figure 3A:
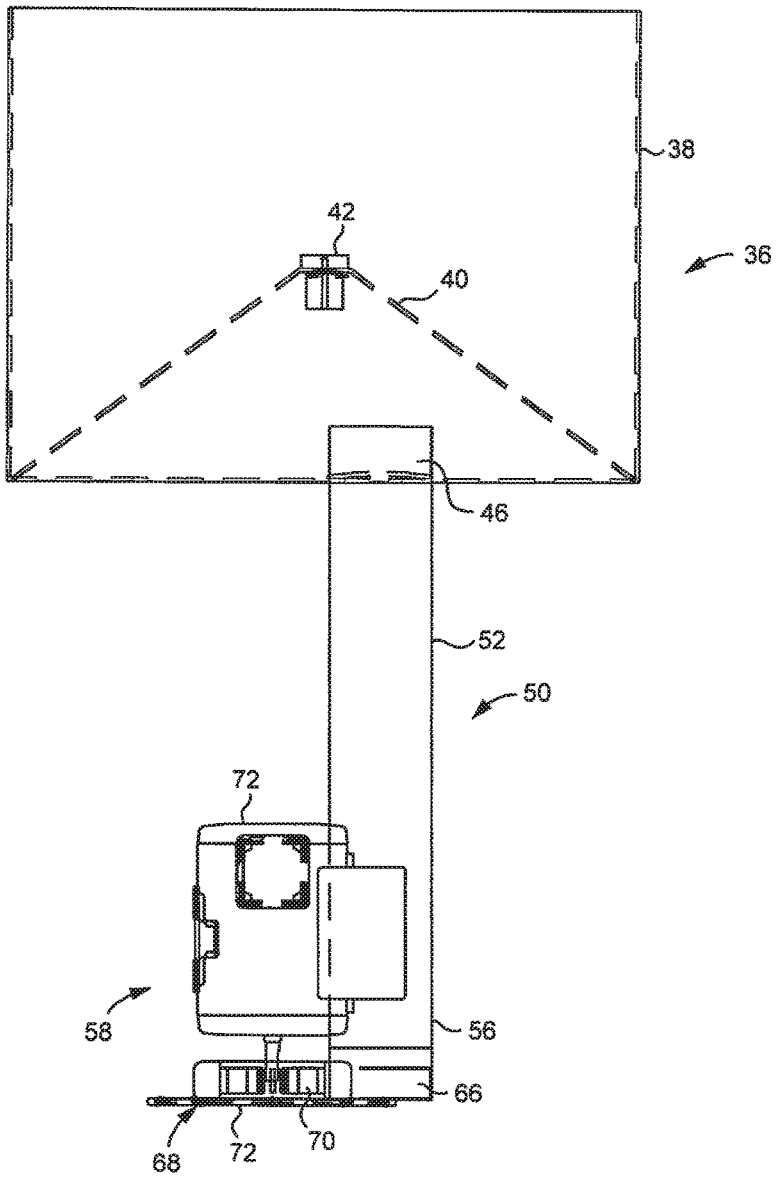
FIG. 3(*a*) depicts a front view of a puck launching system and puck sorting system of the portable hockey training device according to an embodiment of the present invention.
Figure 3B:
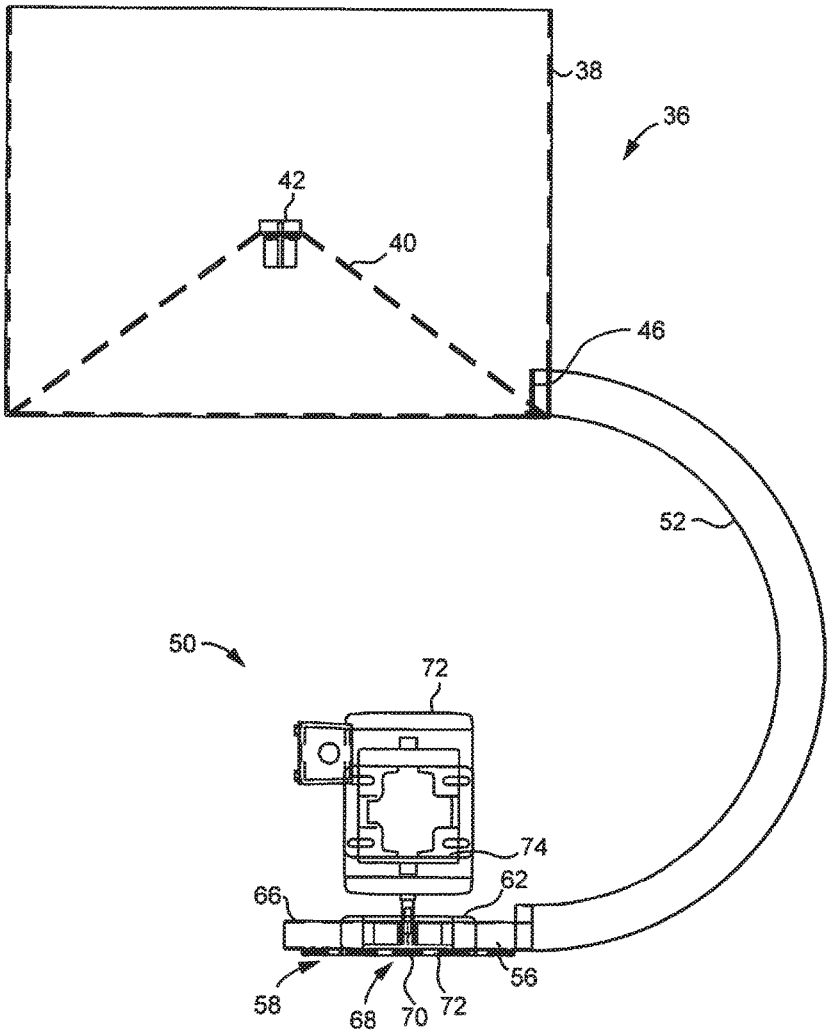
Figure 3C:
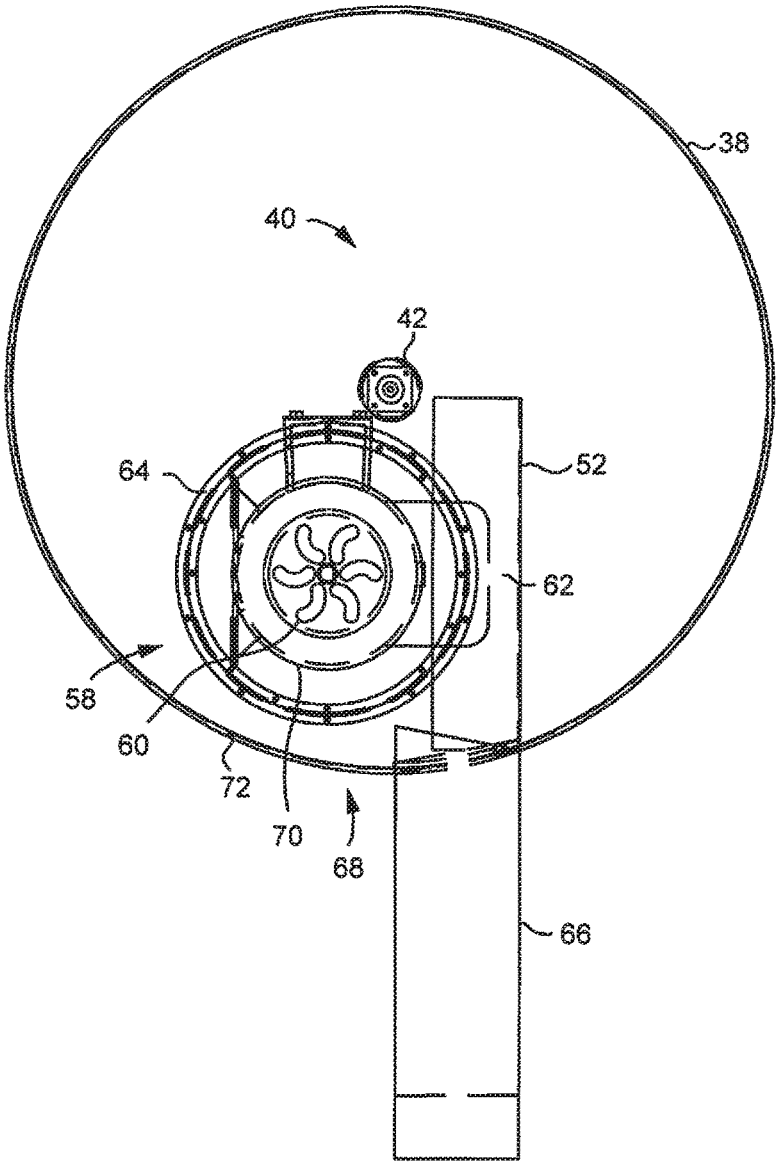
Figure 3D:
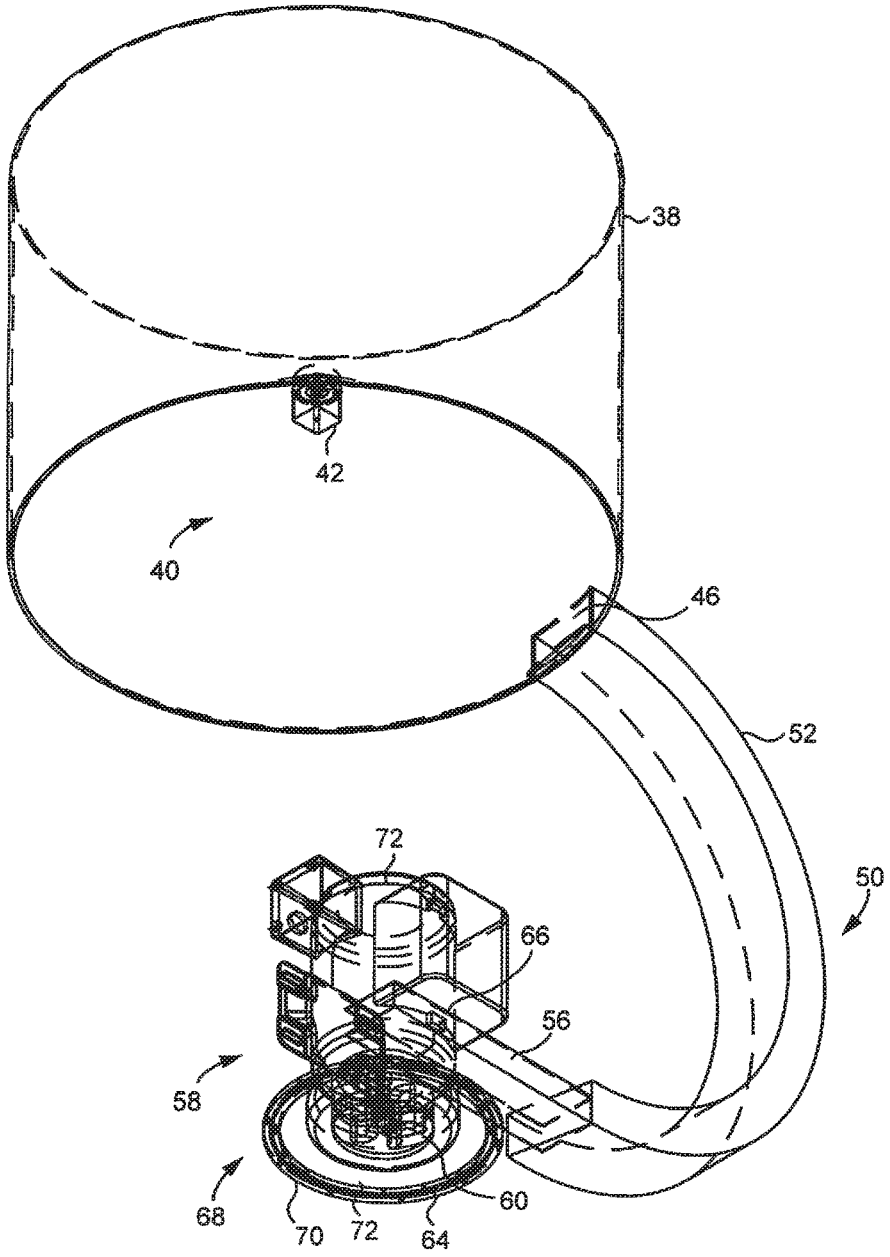

The portable training device further includes a puck launching system 50 attached below the puck sorting system 36. FIG. 3 is a schematic diagram showing a closer look of the puck launching system 50 connected to the puck sorting system 36. FIGS. 3(*a*)-3(*d*) show different perspectives of the puck launching system 50 and puck sorting system 36.

Once pucks are received from the drum 38, they are directed into a sloped tube 52. In a preferred embodiment, the sloped tube 52 is rectangularly shaped, being approximately a ¼ in. wider in all dimensions that a standard hockey puck. The sloped tube 52 gravity-feeds down to a stepper motor 54 attached to a retaining gate 56, which is further connected to a puck launcher 58. The retaining gate 56 both feeds a puck into the launcher 58 and simultaneously prevents the next puck in the sloped tube 52 from being fed into the launcher 58. The retaining gate 56 may be a bar that retracts and extends to feed one puck into the launcher 58 while preventing the next puck in the sloped tube 52 from being fed. The retraction and extension of the retaining gate 56 may be timer based or command controlled remotely.

The launcher 58 includes a launcher motor 60, such as a 115 V HVAC motor, with a ½ in. diameter by 4 in. length shaft 62. The output of the launcher motor 60 may range from about 1200 to 1800 rotations per minute (RPM), with a preferred embodiment being 1725 RPMs. The launcher 58 further includes a soft-rubber, spinning launcher wheel 64 attached to the shaft 62, with preferred dimensions of 1 in. thick by 6 in diameter. The spinning launcher wheel 64 can output at least 30 miles per hour (MPH) of linear velocity, typically outputting about 80 MPH.

A rectangular launching chute 66 attached to the sloped tube 52 can reside tangential to the spinning launcher wheel 64, in one embodiment at a 0.9 in. range. When a puck is fed by the stepper motor 54, a rotational and linear force are placed upon the puck by the spinning launcher wheel 64 squeezing the puck between the launching chute 66 and the spinning launcher wheel 64. The result is a puck launched in a linear motion, with rotation resembling that of the rotation placed on a puck by a hockey stick when a player passes. The speed, aim, and interval of the puck launching system 50 are all controlled by the control system 18.

The portable training device 10 further includes an aiming system 68. The aiming system 68 includes an upper turntable 70 placed above the launching system 50 and a lower turntable 72 placed under launching system 50 along the same axis. These turntables 70 and 72 are actuated by a stepper motor 74 connected to the upper turntable 70. The stepper motor 74 is connected to and controlled by the control system 18.

Due to the high volume of shots training device 10 is likely to encounter while in service, the training device 10 ideally should be durable. Therefore, the entire launching system 50 and control system 18 may be encased in an ultra-high molecular weight (UHMW) plastic housing 76. In a preferred embodiment, the housing 76 is ⅛ in. thick and the same plastic used for boundaries of a standard hockey rink. The housing 76 creates a barrier from pucks while remaining relatively lightweight. The housing 76 may include caster wheels 78 capable of supporting the entire weight of the training device 10 and making the training device 10 easily portable for on or off ice use.

The training device 10 can be powered by a standard 115 volts alternating current (VAC) power source. Alternatively, the training device 10 can be battery powered via replaceable batteries or rechargeable batteries. As an example, lithium ion batteries may be used.

It is understood that the above-described embodiments are only illustrative of the application of the principles of the present invention. The present invention may be embodied in other specific forms without departing from its spirit or essential characteristics. All changes that come within the meaning and range of equivalency of the claims are to be embraced within their scope. Thus, while the present invention has been fully described above with particularity and detail in connection with what is presently deemed to be the most practical and preferred embodiment of the invention, it will be apparent to those of ordinary skill in the art that numerous modifications may be made without departing from the principles and concepts of the invention as set forth in the claims.

What is claimed is:

1. A training device for hockey players, comprising:

a puck sorting system for holding and orienting hockey pucks, the puck sorting system comprising a puck drum having bottom and side portions and configured to hold therein a plurality of hockey pucks, the bottom portion of the puck drum having rotatably mounted thereon a conical puck agitation device configured to orient the plurality of hockey pucks into a predefined position; and a puck launching system attached to the puck sorting system, the puck launching system comprising a sloped tube operable to receive oriented hockey pucks and convey hockey pucks to a puck launcher, the puck launcher configured to shoot hockey pucks via a spinning launching wheel driven by a launching motor.

2. The training device of claim 1, further comprising a training board.

3. The training device of claim 2, wherein the training board further comprises one or more lights indicative of a shot selection.

4. The training device of claim 1, further comprising a control system configured to track each launched puck and each puck shot on target to formulate thereby a shot percentage.

5. The training device of claim 1, wherein the puck drum is configured to hold at least 50 hockey pucks.

6. The training device of claim 1, wherein the puck sorting system further comprises a stirring mechanism to assist with orienting the hockey pucks into the predefined position.

7. The training device of claim 1, wherein the puck launching system is configured to rotate via one or more turntables.

8. The training device of claim 1, wherein the puck launching system further comprises a control system configured to control at least one of a speed, direction, and interval for shooting hockey pucks.

9. The training device of claim 1, wherein the puck launching system further comprises a retaining gate for urging a hockey puck toward the puck launcher while preventing a subsequent hockey puck from being conveyed to the puck launcher.

10. The training device of claim 1, further comprising a housing for the puck launching system.

11. The training device of claim 1, wherein the spinning launching wheel comprises a single wheel.

12. A portable training device for hockey players, comprising:

a puck sorting system for holding and orienting hockey pucks, the puck sorting system comprising a puck drum having bottom and side portions and configured to hold therein a plurality of hockey pucks, the bottom portion of the puck drum having mounted thereon a conical puck agitation device comprising a stirring mechanism to orient the plurality of hockey pucks into a predefined position; and a puck launching system attached to the puck sorting system, the puck launching system comprising a sloped tube operable to receive oriented hockey pucks and convey hockey pucks to a puck launcher, the puck launcher configured to shoot hockey pucks via a spinning launching wheel driven by a launching motor.

13. The training device of claim 12, further comprising a control system configured to track each launched puck and each puck shot on target to formulate thereby a shot percentage.

14. The training device of claim 12, wherein the puck drum can hold at least 50 hockey pucks.

15. The training device of claim 12, wherein the puck launching system is configured to rotate via one or more turntables.

16. The training device of claim 12, wherein the puck launching system further comprises a control system configured to control at least one of a speed, direction, and interval for shooting the hockey pucks.

17. The training device of claim 12, wherein the puck launching system further comprises a retaining gate for urging a hockey puck toward the puck launcher while preventing a subsequent hockey puck from being conveyed to the puck launcher.

18. The training device of claim 12, further comprising a housing for the puck launching system.

19. The training device of claim 12, wherein the spinning launching wheel comprises a single wheel.

20. A portable training device for hockey players, comprising:

a puck sorting system for holding and orienting hockey pucks, the puck sorting system comprising a puck drum having bottom and side portions and configured to hold therein a plurality of hockey pucks, the bottom portion of the puck drum having rotatably mounted thereon a conical puck agitation device configured to automatically orient the plurality of hockey pucks into a predefined position; and a puck launching system attached to the puck sorting system, the puck launching system comprising a sloped tube operable to receive oriented hockey pucks and convey hockey pucks to a puck launcher, the puck launcher configured to shoot hockey pucks via a spinning launching wheel driven by a launching motor.

* * * * *